US010833404B1

(12) United States Patent
Kaddour et al.

(10) Patent No.: US 10,833,404 B1
(45) Date of Patent: Nov. 10, 2020

(54) SCROLLING RECONFIGURABLE ARRAYS

(71) Applicants: Abdul-Sattar Kaddour, Miami, FL (US); Stavros Georgakopoulos, Miami, FL (US)

(72) Inventors: Abdul-Sattar Kaddour, Miami, FL (US); Stavros Georgakopoulos, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/864,335

(22) Filed: May 1, 2020

(51) Int. Cl.
*H01Q 3/46* (2006.01)
*H01Q 3/04* (2006.01)
*H01Q 21/06* (2006.01)

(52) U.S. Cl.
CPC ..... *H01Q 3/04* (2013.01); *H01Q 3/46* (2013.01); *H01Q 21/065* (2013.01)

(58) Field of Classification Search
CPC .. H01Q 3/04; H01Q 3/24; H01Q 3/42; H01Q 3/46; H01Q 21/06; H01Q 21/061; H01Q 21/065
See application file for complete search history.

(56) References Cited

U.S. PATENT DOCUMENTS 9,048,544 B2 * 6/2015 Georgiadis ..... H01Q 3/46
9,640,867 B2 * 5/2017 Behdad ..... H01Q 21/061
2018/0323657 A1 * 11/2018 Hannigan ..... H02J 50/23

OTHER PUBLICATIONS

Legay et al., Recent developments on Reflectarray antennas at Thales Alenia Space, IEEE 2009 3rd European Conference on Antennas and Propagation, Mar. 23-27, 2009.

* cited by examiner

*Primary Examiner* — Hoang V Nguyen
(74) *Attorney, Agent, or Firm* — Saliwanchik, Lloyd & Eisenschenk

(57) ABSTRACT

A scrollable reflectarray antenna system and methods for reconfiguring electromagnetic (EM) characteristics of the reflectarray antenna are provided. The reconfigurable reflectarray antenna includes a flexible substrate; a plurality of reflectarray patterns disposed on a surface of the flexible substrate, each reflectarray pattern comprising a plurality of reflectarray elements; and an actuator system coupled with the flexible substrate. The actuator system is configured to scroll the flexible substrate to different operational positions such that when layout of the plurality of reflectarray patterns is changed, at least one EM characteristic of the reflectarray antenna is reconfigured. In a predetermined operational position, an aperture of the reflectarray is formed by two reflectarray patterns that are optimized to direct an illuminating beam in a new direction.

20 Claims, 12 Drawing Sheets

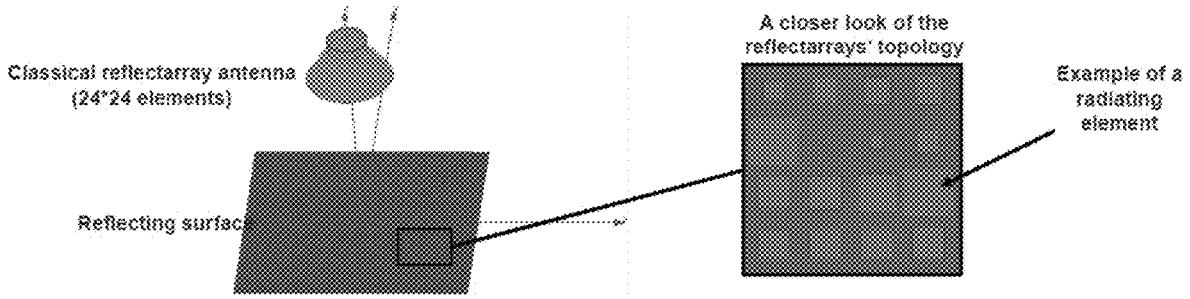
Fig. 1
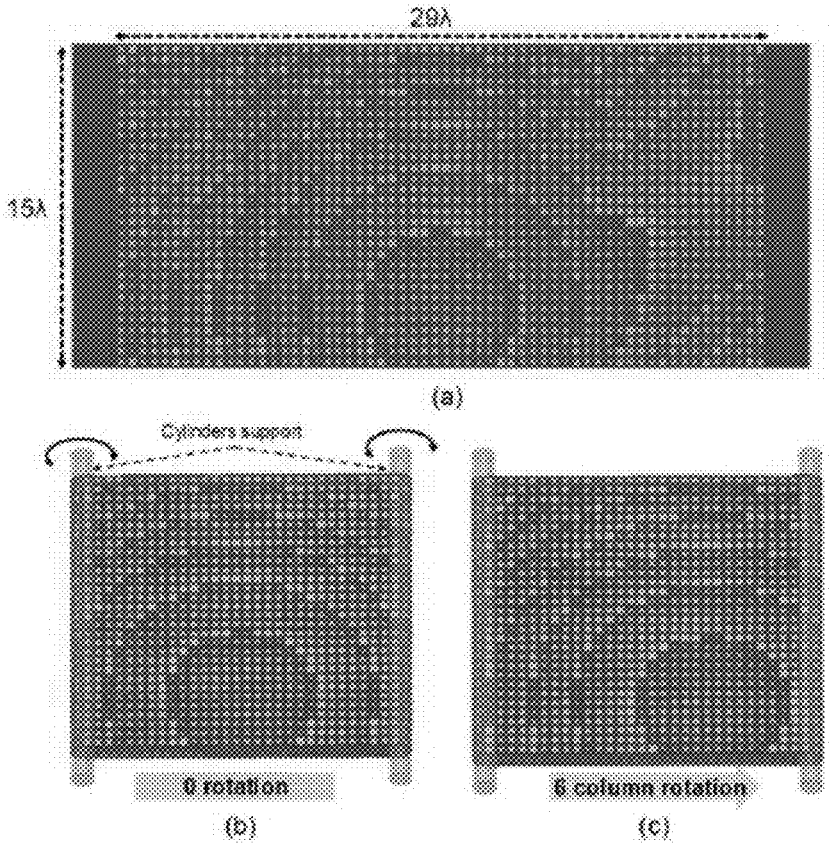
Fig. 2(a)-(c)

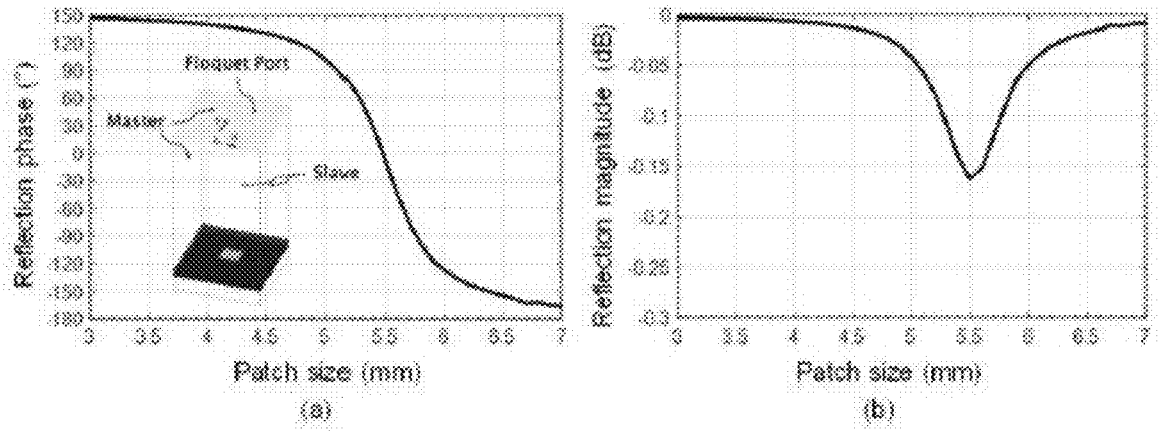
Fig. 3(a)-(b)
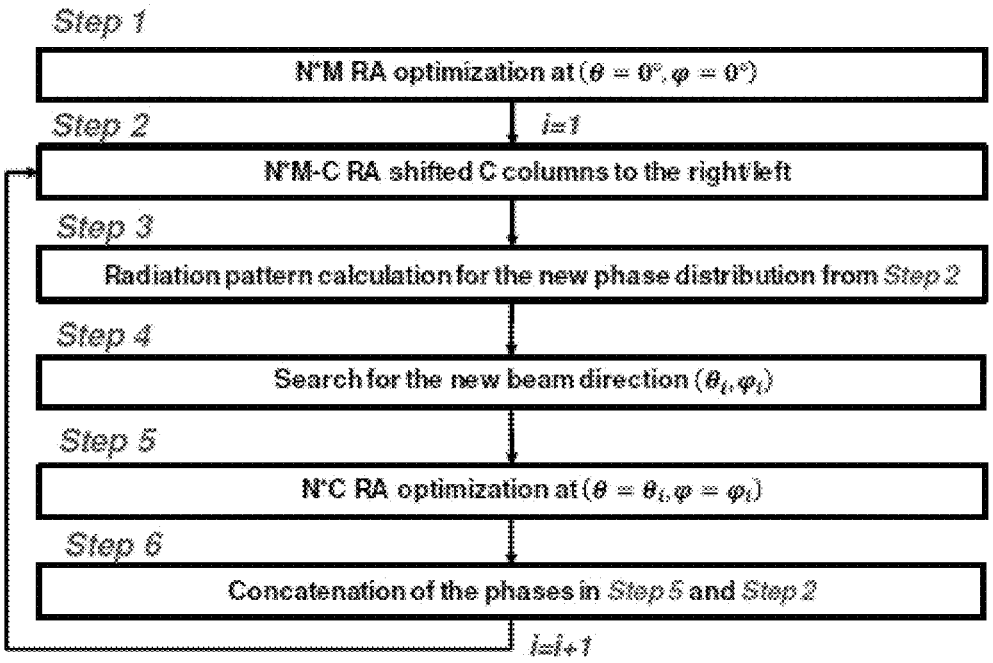
Figure 4

Fig. 5(a)-(b)

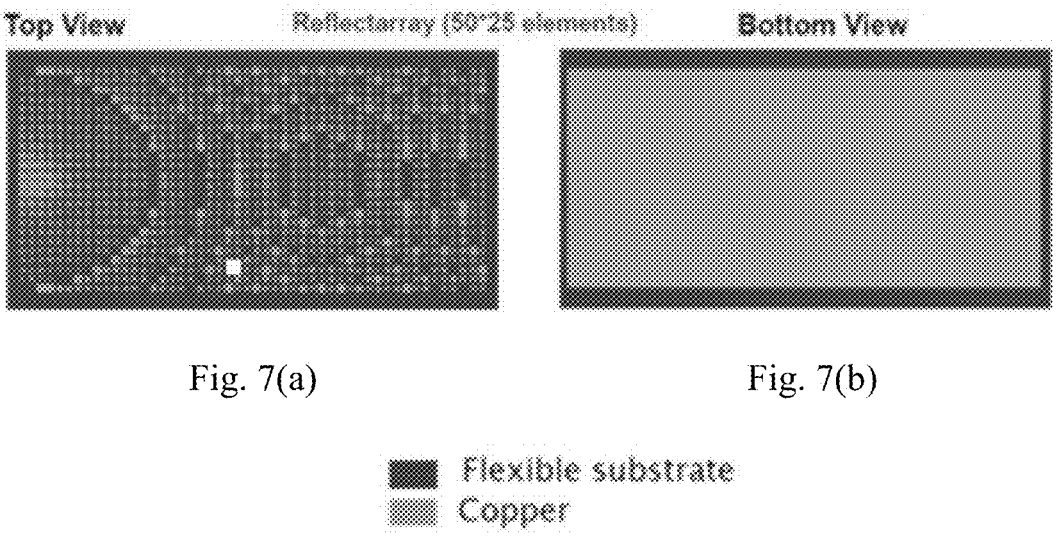
Fig. 7(a)
Fig. 7(b)
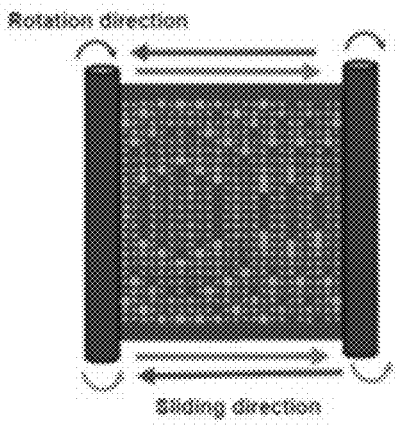
Fig. 7(c)

Case 1: reflectarray (25*25 elements) that steers the beam in the broadside direction (θ=0°,φ= 0°).
Case 2: reflectarray (25*25 elements) that steers the beam in the direction (θ=-30°,φ= 0°).
Case 3: reflectarray (25*25 elements) that steers the beam in the direction (θ=30°,φ= 0°).
Case 4: reflectarray (50*25 elements) that steers the beam in the direction (θ=0°,φ= 0°) and exhibits higher gain.

SCROLLING RECONFIGURABLE ARRAYS

GOVERNMENT SUPPORT

This invention was made with government support under Award Number FA9550-18-1-0191 awarded by the Air Force. The government has certain rights in the invention.

BACKGROUND

In the past decades, reflectarray antennas (RAs) as a new concept have been proposed for beam-steering applications due to their advantages over reflectors and phased arrays. To realize a steerable radiation pattern, the phase distribution $\phi(x_i,y_i)$ on the RA aperture needs to be tuned corresponding to the desired beam direction. The phase distribution for each element on the RA aperture instantly includes two components as shown in equation (1)

$$\phi(x_i,y_i)=-k_0R_i+\phi_R(x_i,y_i) \quad (1)$$

where $-k_0R_i$ and $\phi_R(x_i,y_i)$ are the phase delay and the progressive phase, respectively.

Different tuning approaches, such as, aperture phase tuning techniques and feed tuning are investigated for beam-scanning RAs. Phase tuning techniques typically can be implemented by different technologies, for example, micromotors, pin-diodes and RF-MEMS. Despite supporting higher speed beam control, phase tuning suffers from various limitations including design complexity, increased fabrication costs, and low efficiency caused by high loss. On the other hand, the feed tuning technique changes the phase of an RA aperture by tuning the spatial delay. For beam-scanning applications, the phase center of the feed antenna is required to be displaced in a specific path (e.g., lateral or circular arc path). However, these techniques require a complicated mechanical design and the aperture efficiency of the RA has a dependency on the feed position.

BRIEF SUMMARY

There continues to be a need in the art for improved designs and techniques for beam-scanning RAs. Embodiments of the subject invention pertain to using scrollable reflectarray reflecting surfaces of RA antennas for reconfiguring electromagnetic (EM) characteristics of the antennas.

In an embodiment, a reconfigurable reflectarray antenna comprises: a flexible substrate; a plurality of reflectarray patterns disposed on a surface of the flexible substrate, each reflectarray pattern comprising a plurality of reflectarray elements; and an actuator system coupled with the flexible substrate. The actuator system is configured to scroll the flexible substrate to different operational positions such that when layout of the plurality of reflectarray patterns is changed, at least one electromagnetic (EM) characteristic of the reflectarray antenna is reconfigured. In a predetermined operational position, an aperture of the reflectarray is formed by two reflectarray patterns that are optimized to direct an illuminating beam in a new direction. The at least one EM characteristic comprises one or more of beamsteering, polarization, and frequency. Phase distributions of the plurality of reflectarray elements are optimized to steer illuminating beams in predetermined directions.

The plurality of reflectarray elements is configured to operate, for example, in Ku-band at a center frequency of 16 GHz and with an element spacing of 18.75 mm (0.5λ). A 313° range of reflection phase response is achieved with a maximum loss of 0.17 decibels (dB). The plurality of reflectarray patterns having a fixed aperture size and the plurality of reflectarray elements has a rectangular shape, a square shape, or a circular lattice shape. Moreover, the actuator system comprises two supporting members coupled to two ends of the flexible substrate, respectively. The actuator system additionally comprises an actuator coupled to the two supporting members for scrolling the flexible substrate. The actuator is configured to actuate the two supporting members to move the flexible substrate by a rotational motion or a sliding motion and the actuator comprises a step motor. Furthermore, the layout of the plurality of reflectarray patterns is moved into different operational positions to provide different directions of illuminating beams. Only one reflectarray pattern of the plurality of reflectarray patterns is exposed to be illuminated for each operational position. In addition, the flexible substrate is made of plastic, polyimide (e.g., Kapton®), polyethylene terephthalate (PET) (e.g., biaxially-oriented PET (Mylar®)), or textile. The surface of the flexible substrate on which the plurality of reflectarray patterns is disposed being a flat or a curved reflecting surface. The flexible substrate has another surface opposite to the surface on which the plurality of reflectarray patterns is disposed and another surface being at least partially covered by a metal and the metal is copper.

In another embodiment, a method for optimizing phase distributions of a plurality of reflectarray elements of a reconfigurable reflectarray antenna to steer illuminating beams in predetermined directions is provided. The method comprises: (1) optimizing phase distribution of an aperture of the reflectarray elements to have a broadside radiation ($\theta=0°$, $\phi=0°$); (2) shifting the reflectarray elements by $0.5\lambda\times C$ to a right direction and covering the reflectarray elements in the last C columns on the right side; (3) taking into account the new position of the reflectarray elements in radiation pattern from step (2) and calculating the phase distribution, (4) determining directions of the new beam ($\theta_i$, $\phi_i$); (5) radiating the new C columns on the left side of the reflectarray in the direction ($\theta_i$, $\phi_i$) determined in step (4) and calculating the required phase distribution; and (6) combining the phases obtained from step (5) and step (2) to form a new reflectarray phase distribution.

BRIEF DESCRIPTION OF DRAWINGS

FIG. 1 is a schematic representation of a reflectarray antenna, according to an embodiment of the subject invention.

FIGS. 2(*a*)-(*c*) show (a) a top view of a full reflectarray reflecting surface; (b) a reflectarray aperture formed by the reflectarray elements when no rotation is performed by two cylinders coupled with the reflectarray reflecting surface; and (c) the reflectarray reflecting surface of (b) being moved to the right side by 6 columns by rotations of the two cylinders coupled with the reflectarray reflecting surface, according to an embodiment of the subject invention.

FIGS. 3(*a*)-(*b*) are diagrams showing results of (a) phase unit cell simulations of the reflectarray antenna, and (b) magnitude response unit cell simulations of the reflectarray antenna, according to an embodiment of the subject invention.

FIG. 4 shows a flow chart of procedures for optimization of performance of the reflectarray antenna, according to an embodiment of the subject invention.

FIGS. 7(*a*)-(*c*) are schematic representations of a scrollable and reconfigurable reflectarray reflecting surface with a fixed aperture size that can reconfigure its beam direction by placing a portion or a pattern of the reflectarray reflecting surface in operational position by scrolling motions to be illuminated by the feed of the reflectarray antenna, (a) a top view of the full reflectarray reflecting surface on the flexible substrate, (b) a bottom view of a bottom surface of the flexible substrate opposite to the reflectarray reflecting surface, and (c) the supporting members such as cylinders in rotational motions and the reflectarray reflecting surface in sliding motions, according to an embodiment of the subject invention.

DETAILED DESCRIPTION

Figure 5:
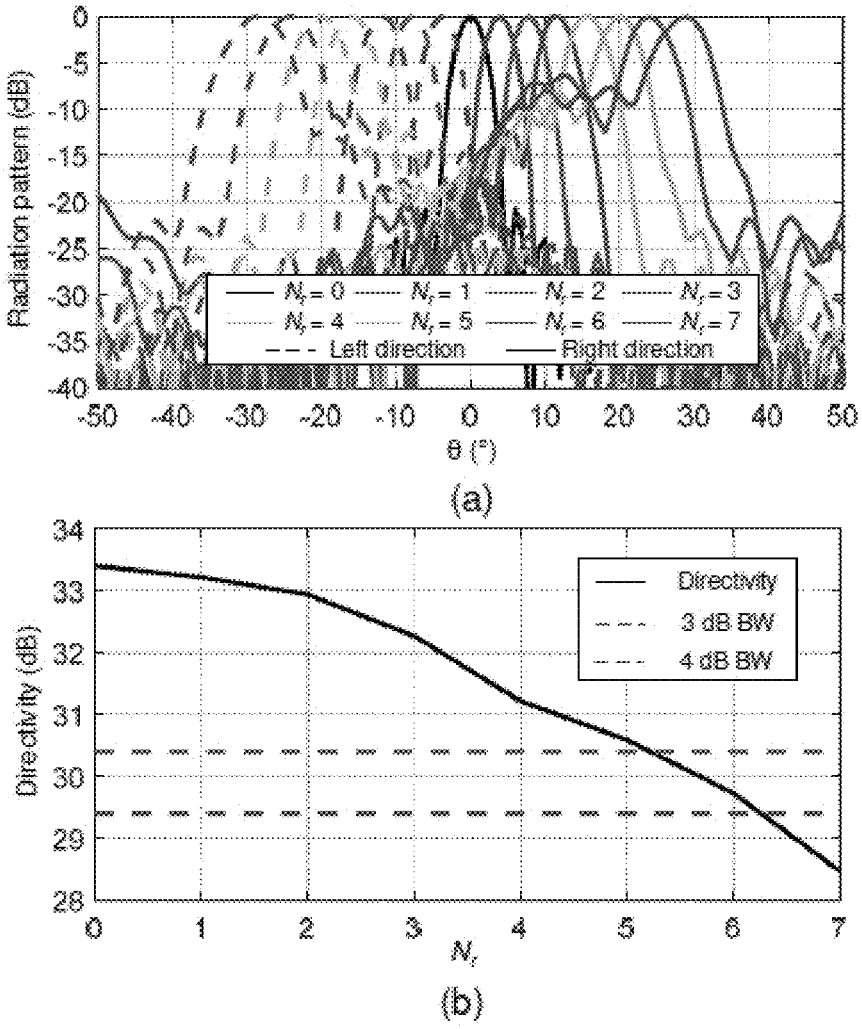
FIGS. 5(*a*)-(*b*) are diagrams of results of performance of the scrollable and reconfigurable reflectarray antenna, (a) showing a scanned radiation pattern, and (b) showing directivity versus the number of rotations Nr and the direction, according to an embodiment of the subject invention.

Embodiments of the subject invention provide novel and advantageous reflectarray (RA) antennas including scrollable and reconfigurable reflectarray reflecting surfaces for reconfiguring electromagnetic (EM) characteristics of the RA antennas.

Referring to FIG. 1, a reflectarray is an antenna comprising a feed transmitting waves/beams onto a reflecting surface and an array of reflecting elements arranged on the reflecting surface such that the waves/beams reflected from the individual reflecting elements combine to produce a prescribed radiation pattern.

The reflecting surface of the RA antenna can be either a flat or a slightly curved surface of a substrate and the array of reflecting elements disposed on the reflecting surface can form a variety of reflectarray patterns. The feed of the RA antenna spatially transmits waves/beams to illuminate the reflectarray patterns that are designed to reradiate and scatter the incident field with phases required to form a planar phase front in the far-field distance.

To generate the planar phase front, the reflectarray elements can be formed of a plurality of unit cells ("patches") having variable sizes such that the reflectarray elements have different scattering impedances, resulting in different phases to compensate for different feed-path delays.

FIG. 2(*a*) shows a full layout of the plurality of reflectarray elements according to one embodiment of the subject invention. The reflectarray elements are formed of 58×30 square unit cells ("patches") printed on a reflecting surface of a flexible substrate that may be made of plastic (for example, $\varepsilon_r=2.33$, tan $\gamma=0.003$ and thickness 0.73 mm), polyimide (e.g., Kapton®), PET (e.g., biaxially-oriented PET (Mylar®)), or textile.

In one embodiment, the reflectarray antenna can further comprise an actuator system coupled with the flexible substrate and configured to move flexible substrate in a horizontal direction to scroll a portion or entirety of the layout of the plurality of reflectarray elements disposed on the flexible substrate to different operational positions such that when the layout of the plurality of reflectarray elements is changed, at least one electromagnetic (EM) characteristic of the reflectarray antenna is reconfigured accordingly.

In one embodiment, the actuator system can comprise two supporting members such as two cylinders coupled to two ends of the flexible substrate, respectively, and an actuator coupled to the two supporting members to control and actuate the scrolling of the flexible substrate. In an example, the actuator is configured to simultaneously rotate the two supporting members with respect to their own axes in a clockwise direction or in a counterclockwise direction. Consequently, the plurality of reflectarray elements disposed on the flexible substrate is moved to a predetermined operational position by a sliding motion of the flexible substrate and thus provides different directions of illuminating waves/beams from the feed. The two supporting members may be two cylinders in fixed positions and securely attached to the flexible substrate. Since the two supporting members are in the fixed positions, when the layout of the plurality of reflectarray elements is scrolled, the operational length of the layout at a given operation position is fixed.

Referring to FIG. 2(*b*), a reflectarray aperture of 30×30 square patches is formed by the reflectarray elements, when the reflectarray reflecting surface is in an initial operational position without any rotations performed by the actuator system that is coupled with the reflectarray reflecting surface.

In FIG. 2(*c*), when the two supporting members such as two cylinders are rotated with respect to their own axes by a certain rotations, the layout of the reflectarray reflecting surface is caused to slide to a new operational positon that is 6 columns to the right of the initial operational position. Since the feed position is intact, the same aperture efficiency is maintained through the simple mechanism.

In one embodiment, the actuator controlling and performing the rotations of the supporting members can include, but not limited to, robotics or motors such as a step motor.

In one embodiment, the plurality of reflectarray elements of the RA antenna are designed to operate in the Ku-band at a center frequency of about 16 GHz and with an element spacing of about 18.75 mm (0.5λ). The phase and amplitude responses of the reflectarray elements for various patch sizes are simulated for normal incidence at about 16 GHz and the simulation results are shown in FIGS. 3(*a*) and 3(*b*), respectively. It is observed from the figures that a 313° range of reflection phase response can be achieved with a maximum loss of 0.17 dB.

To achieve beam-steerable capabilities as the plurality of reflectarray elements of the RA antenna is scrolled, the phase distributions of the reflectarray elements can be optimized by an optimization procedure discussed below.

Referring to FIG. 4, first, in Step 1, the phase distribution of a reflectarray aperture of N×M patches is optimized to have a broadside radiation (θ=0°, ϕ=0°), where N and M are the numbers of patches along the x-axis and the y-axis, respectively. Next, in Step 2, the reflectarray elements are shifted by 0.5λ×C to the right side such that the reflectarray elements in the last C columns on the right side are removed (rolled to the back). Then, in Step 3, the radiation pattern taking into account the new operational position of the reflectarray elements from Step 2 and their phase distribution is calculated based on the reflectarray theory. Next, in Step 4, the direction of the new beam (θi, ϕi) is searched and determined. It is noted that the beam is steered in the direction of the rotation due to the modification of the phase delay in that direction. Then, in Step 5, the new C columns of layout that appeared on the left side of the reflectarray reflecting surface should radiate in the direction (θi, ϕi) determined in the Step 4 and their required phase distribution is calculated. Finally, in Step 6, the phases obtained from both the Step 5 and the Step 2 are combined to form a new N×M reflectarray phase distribution. This optimization procedure is then repeated for the number of the implemented rotations in both directions to the right side and to the left side.

In one embodiment, the optimization procedure of the phases distribution described is applied to a reconfigurable reflectarray having 30×30 patches with rotations of two columns. The radiation patterns and the directivity for a different number of rotation Nr and direction are obtained and plotted in FIG. 5(*a*) and FIG. 5(*b*), respectively. It can be seen from the figures that ±20° beam steering angles and ±24° beam steering angles are achieved for a 3 dB and 4 dB bandwidth from the maximum radiation in the broadside direction, respectively. The steering step is determined to be about 4°, and can be reduced to about 2° if only one column is shifted in each rotation (C=1).

In one embodiment, multiple reflectarray reflecting surfaces can be formed as a single combinational reflectarray reflecting surface to save space. The scrollable RA antenna provides electromagnetic reconfigurability including, for example, beamsteering reconfigurability, polarization reconfigurability, and frequency reconfigurability by scrolling the layout of the reflectarray reflecting surface, resulting in enhanced performance with low losses and low costs compared to conventional reconfigurable reflectarrays.

Figure 6:
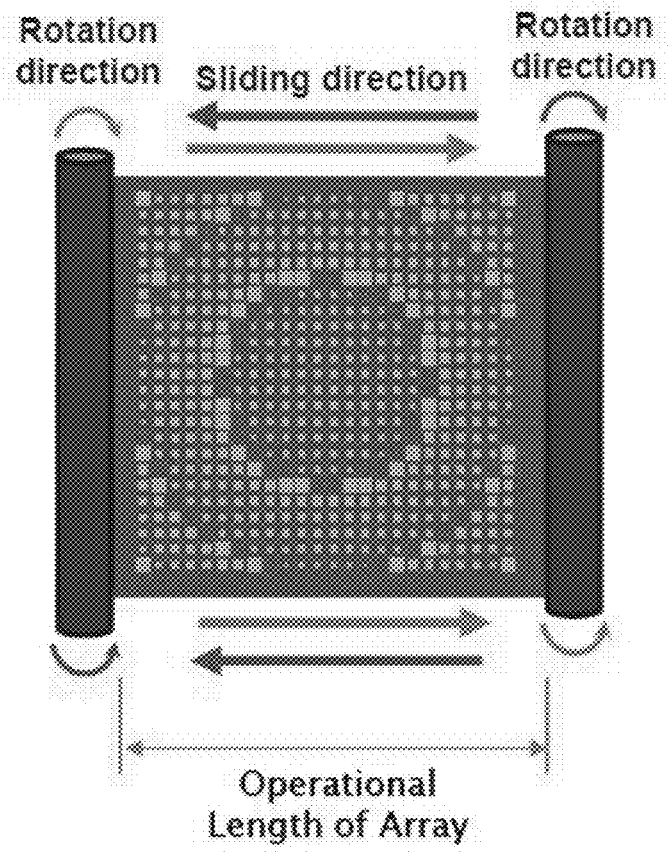
FIG. 6 is a schematic representation of the rotational reflectarray with reconfigurable beam direction, according to an embodiment of the subject invention.

As illustrated in FIG. 6, the scrollable and reconfigurable reflectarray reflecting surface can have different reflectarray patterns that are scrollably steered to different operational positions to provide directions of the waves/beams. The reflectarray reflecting surface can be steered by a sliding motion, achieving multiple operational states. The reflectarray reflecting surface can be motorized to slide to loop through different array patterns using an appropriate actuation system such as a step motor system. When the operational position and the patterns of the reflectarray reflecting surface change, the electromagnetic behaviors of the reflectarray antenna change accordingly.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example One: Scrollable and Reconfigurable Reflectarray Reflecting Surface with a Fixed Aperture Size FIG. 7(*a*)-(*c*) are schematic representations of a scrollable and reconfigurable reflectarray reflecting surface with fixed aperture size that can reconfigure its beam direction by scrolling a portion or a pattern of the full reflectarray reflecting surface in an operational position to be illuminated by the feed of the reflectarray antenna. In particular, FIG. 7(*a*) shows a top view of the full reflectarray reflecting surface on the flexible substrate, FIG. 7(*b*) shows a bottom view of a bottom surface of the full flexible substrate opposite to the reflectarray reflecting surface, and FIG. 7(*c*) shows the supporting members such as cylinders in rotational motions with respect to their own axes and the reflectarray reflecting surface in sliding motions as a result.

In one embodiment, the reflectarrays elements can have different shapes such as a rectangular shape, a square shape, or a circular lattice shape.

In one embodiment, the number of the rotation steps of the supporting members can be automatically or manually adjusted depending on the desired steering direction.

When the reflectarray reflecting surface is scrolled by a specific number of columns, the aperture of the reflectarray is formed by two new reflectarrays patterns that are optimized to direct the beam in a new direction.

The reflectarray reflecting surface is formed with a plurality of reflectarray elements and the number of the reflectarray elements depends on the number of desired operation states. The size of the reflectarray elements can be determined by an optimization process to ensure the best radiation characteristics. For each operational state, only one reflectarray pattern can be illuminated. The reflectarray reflecting surface can be scrolled in different directions, for example, in a left direction (indicated by the red line in FIG. 7(*c*)) or in a right direction (indicated by the blue line in FIG. 7(*c*)). A new reflectarray pattern is exposed to be illuminated in a different operational state.

Figure 8:
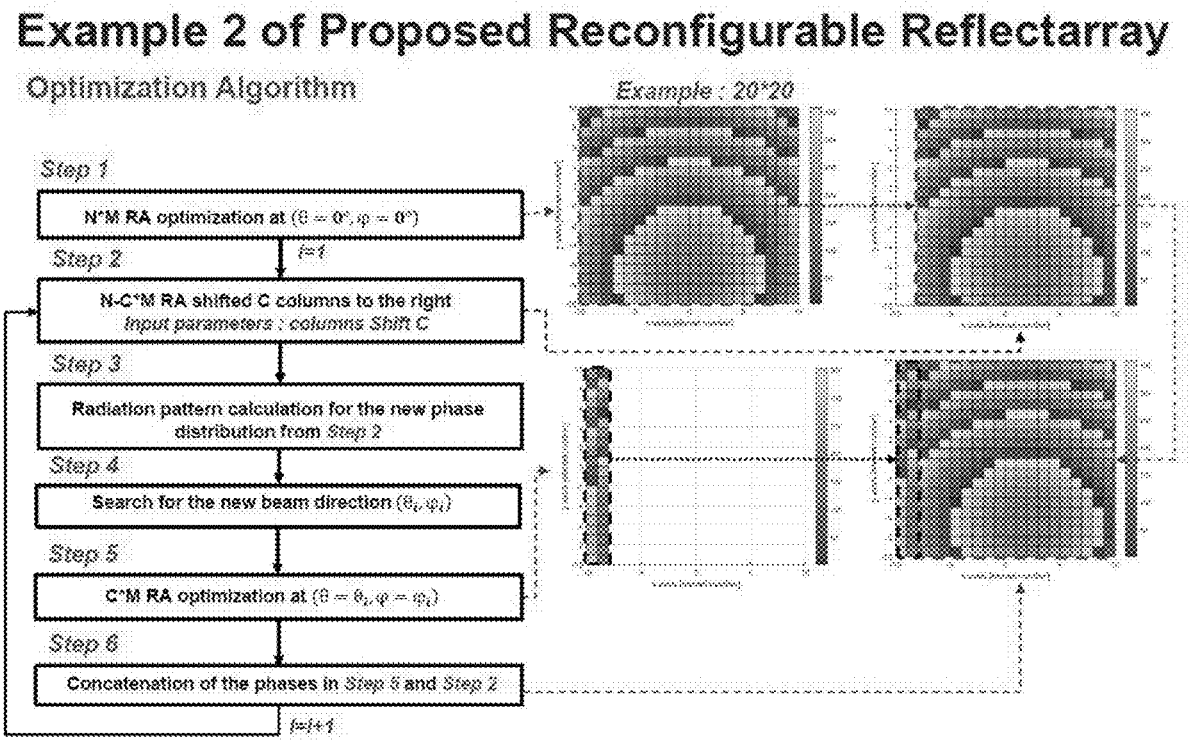
FIG. 8 is a flow chart of optimization procedures for the reflectarray antenna of example two, according to an embodiment of the subject invention.

Referring to FIG. 8, a flow chart of an optimization process of the reflectarray elements and corresponding reflectarray patterns are shown. The optimization process employs same optimization steps as these shown in FIG. 4.

Figures 9A, 9B:
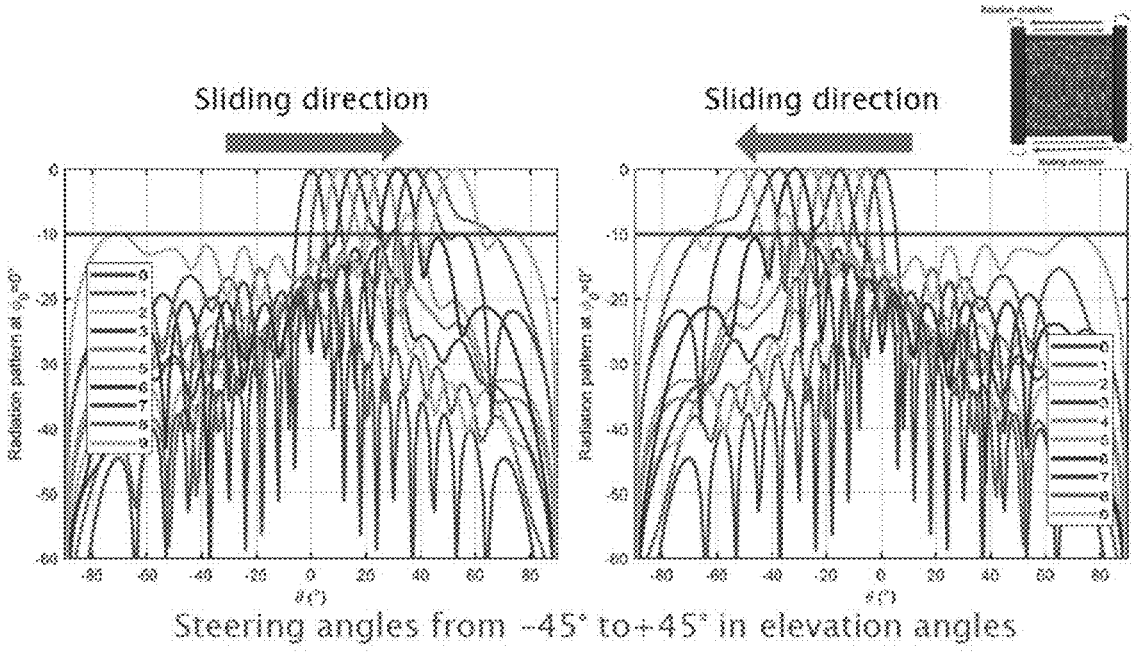
FIGS. 9(*a*)-(*b*) are diagrams showing results of performance of the scrollable reflectarray antenna, (a) showing a scanned radiation pattern when sliding to the right, and (b) showing a scanned radiation pattern when sliding to the left; according to an embodiment of the subject invention.

The performance testing results of the scrollable and reconfigurable reflectarray antenna are illustrated by the diagrams of FIG. 9(*a*)-(*b*). In particular, FIG. 9(*a*) shows a scanned radiation pattern when the reflectarray patterns slide to the right side, and FIG. 9(*b*) shows a scanned radiation pattern when the reflectarray patterns slide to the left side. It is observed from the figures that the steering angles may range from about −45° to about +45 in elevation angles.

Figure 10A:
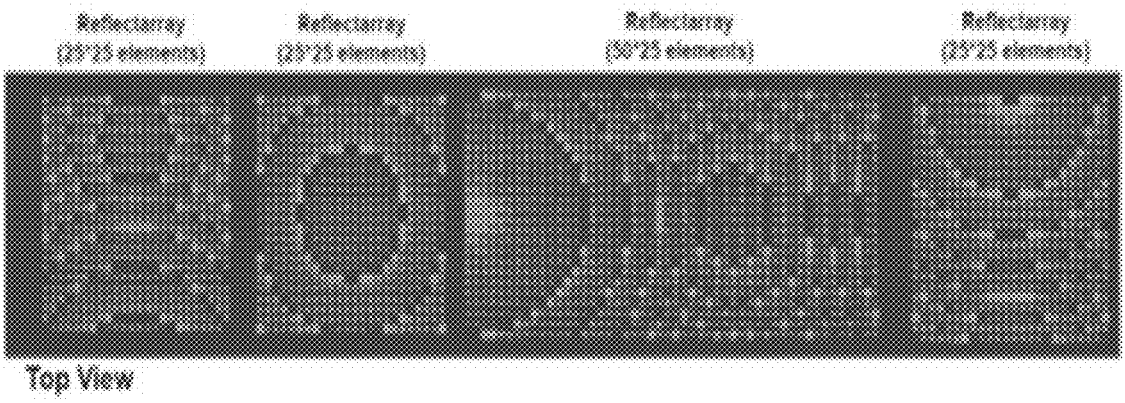
FIGS. 10(*a*)-(*b*) show (a) a top view and (b) a bottom view of a scrolling reflectarray that can reconfigure its beam direction by placing 1 out of 4 patterns in operational position to be illuminated by the feed antenna, according to an embodiment of the subject invention.
Figure 10B:
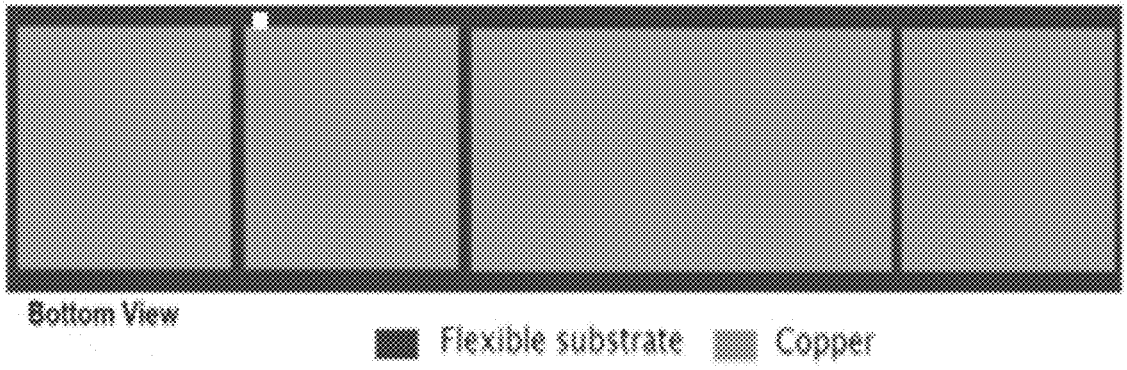

Example Two: Scrollable Reconfigurable Reflectarray Reflecting Surface Reconfiguring the Beam Direction by Placing 1 Out of 4 Reflectarray Patterns in an Operational Position to be Illuminated by the Feed of the Reflectarray Antenna FIG. 10(*a*) shows a top view of the full reflectarray reflecting surface disposed on the flexible substrate, where the full reflectarray reflecting surface is formed with a first reflectarray pattern of 25×25 elements, a second reflectarray pattern of 25×25 elements, a third reflectarray pattern of 50×25 elements, and a fourth reflectarray pattern of 25×25 elements. The reflectarray reflecting surface can reconfigure its beam direction by placing 1 out of 4 patterns in an operational position by scrolling the reflectarray and increasing or decreasing the areas of the reflectarray exposed to be illuminated by the feed of the reflectarray antenna. FIG. 10(*b*) shows a bottom view of a bottom surface of the flexible substrate opposite to the reflectarray reflecting surface.

Figure 11:
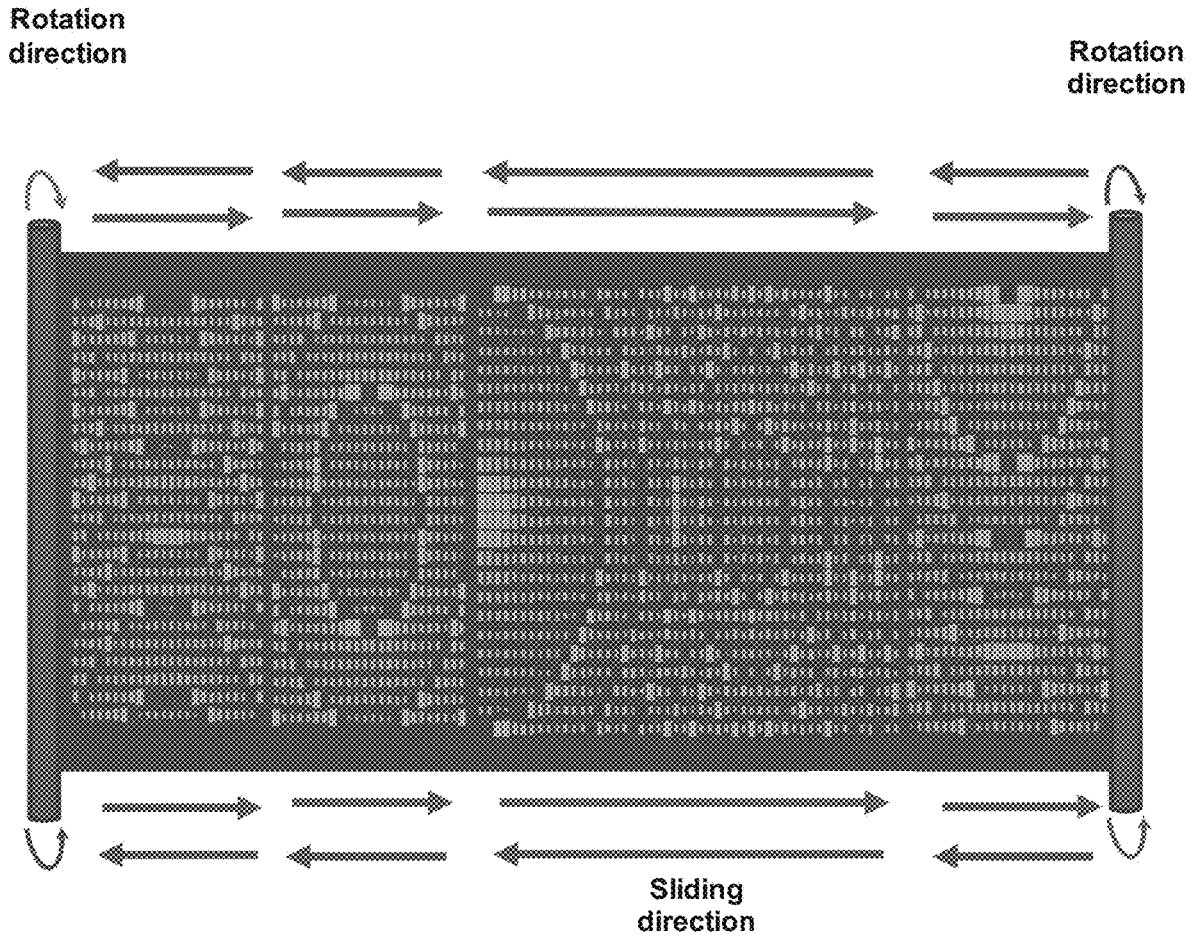
FIG. 11 shows the scrolling reflectarray of FIG. 10(*a*)-(*b*) and the sliding directions and rotation directions of the scrolling reflectarray, according to an embodiment of the subject invention.

Referring to FIG. 11, two supporting members are coupled to two ends of the reflectarray reflecting surface. When the two supporting members such as two cylinders are driven by an actuator to rotate with respect to their own axes in either a clockwise direction or a counterclockwise direction, the reflectarray reflecting surface will consequentially have a sliding motion either to the left side or to the right side.

Figure 12A:
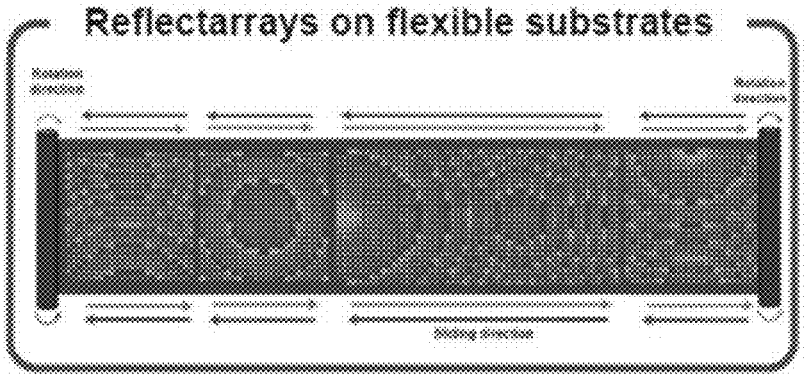
FIGS. 12(*a*)-(*c*) show (a) the scrolling reflectarray comprising a plurality of patterns of reflectarrays printed side by side on a flexible substrate, (b) for each operation state only one pattern of the reflectarray is illuminated, and (c) a new pattern of reflectarray enters into a different operation state, according to an embodiment of the subject invention.
Figure 12B:
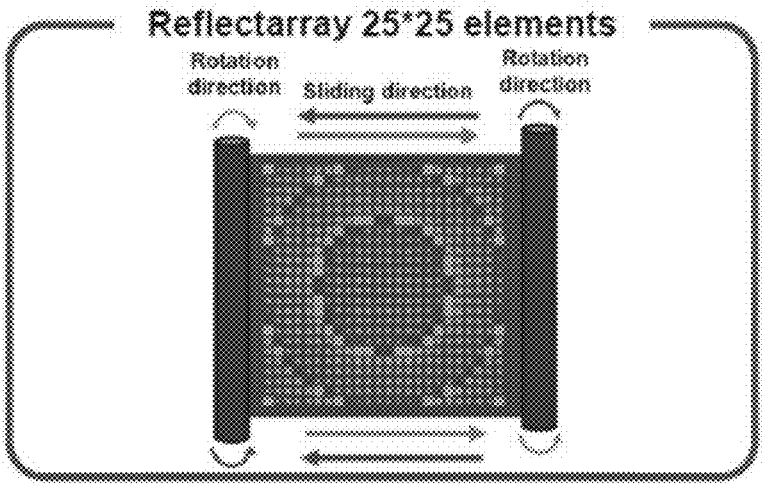
Figure 12C:
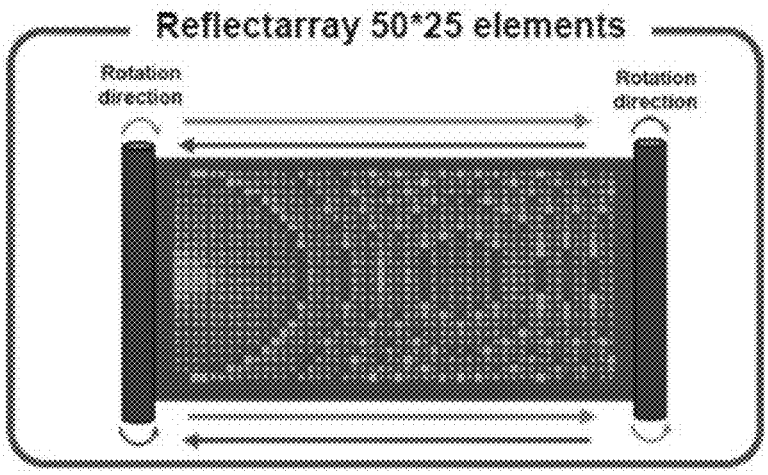
Figure 13A:
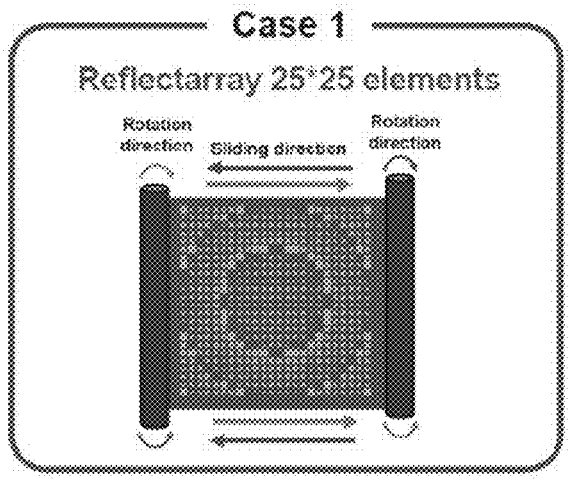
FIGS. 13(*a*)-(*d*) show the scrolling reflectarray in four different cases: (a) case 1: a first pattern of reflectarray (25*25 elements) steering the beam in a first broadside direction ($\theta=0°$, $\varphi=0°$); (b) case 2: a second pattern of reflectarray (25*25 elements) steering the beam in a second direction ($\theta=-30°$, $\varphi=0°$); (c) case 3: a third pattern of reflectarray (25*25 elements) steering the beam in a third direction ($\theta=30°$, $\varphi=0°$); and (d) case 4: a fourth pattern of reflectarray (50*25 elements) steering the beam in a fourth direction ($\theta=0°$, $\varphi=0°$) and exhibiting higher gain, according to an embodiment of the subject invention.
Figure 13B:
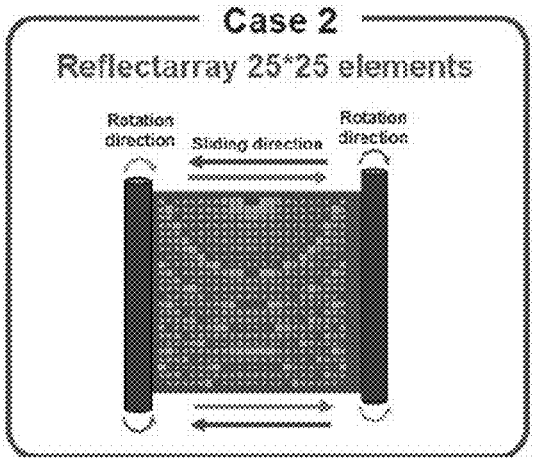
Figure 13C:
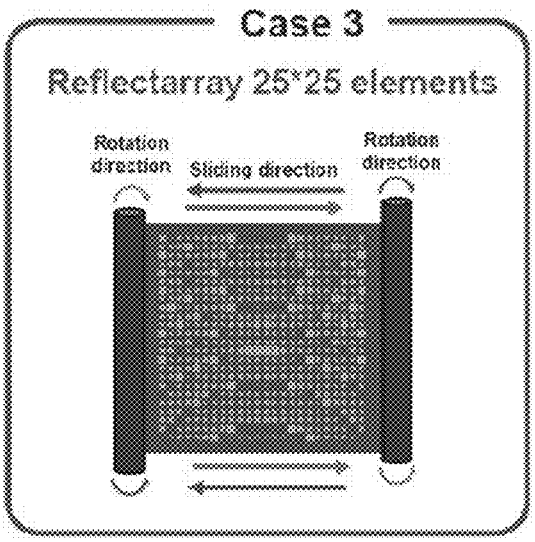
Figure 13D:
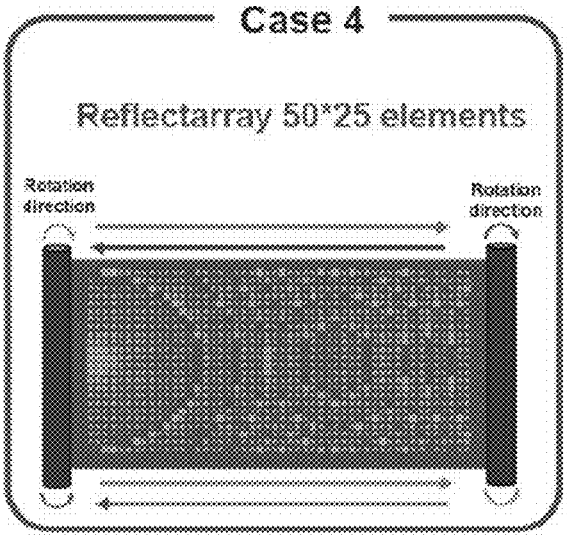

FIG. 12(*a*) shows the full reflectarray reflecting surface comprising the four patterns of reflectarrays printed side by side on a flexible substrate. FIG. 12(*b*) shows that for one operational state, only one pattern of 25×25 elements of the reflectarray reflecting surface is illuminated. FIG. 12(*c*) shows that in another operational state, only the pattern of 50×25 elements of the reflectarray reflecting surface is illuminated.

It is noted that for each operational state, only one pattern of reflectarray is illuminated. The reflectarray can be rotated in different directions, for example, a left direction (indicated by the red line in FIGS. 12(*a*)-(*c*)) or a right direction (indicated by the blue line in FIG. 12(*a*)-(*c*)). A new pattern of reflectarray reflecting surface enters a different operational state.

Referring to FIGS. 13(*a*)-(*d*), the scrollable and reconfigurable reflectarray in four different cases are illustrated. In particular, FIG. 13(*a*) shows that in case 1, a first pattern of reflectarray comprises 25×25 elements and steers the beam in a first broadside direction ($\theta=0°$, $\varphi=0°$). FIG. 13(*b*) shows that in case 2, a second pattern of the reflectarray comprises 25×25 elements and steers the beam in a second direction ($\theta=-30°$, $\varphi=0°$). FIG. 13(*c*) shows that in case 3, a third pattern of the reflectarray comprises 25×25 elements and steers the beam in a third direction ($\theta=30°$, $\varphi=0°$). FIG. 13(*d*) shows that in case 4, a fourth pattern of the reflectarray comprises 50×25 elements and steers the beam in a fourth direction ($\theta=0°$, $\varphi=0°$) and exhibits higher gain.

Figure 14:
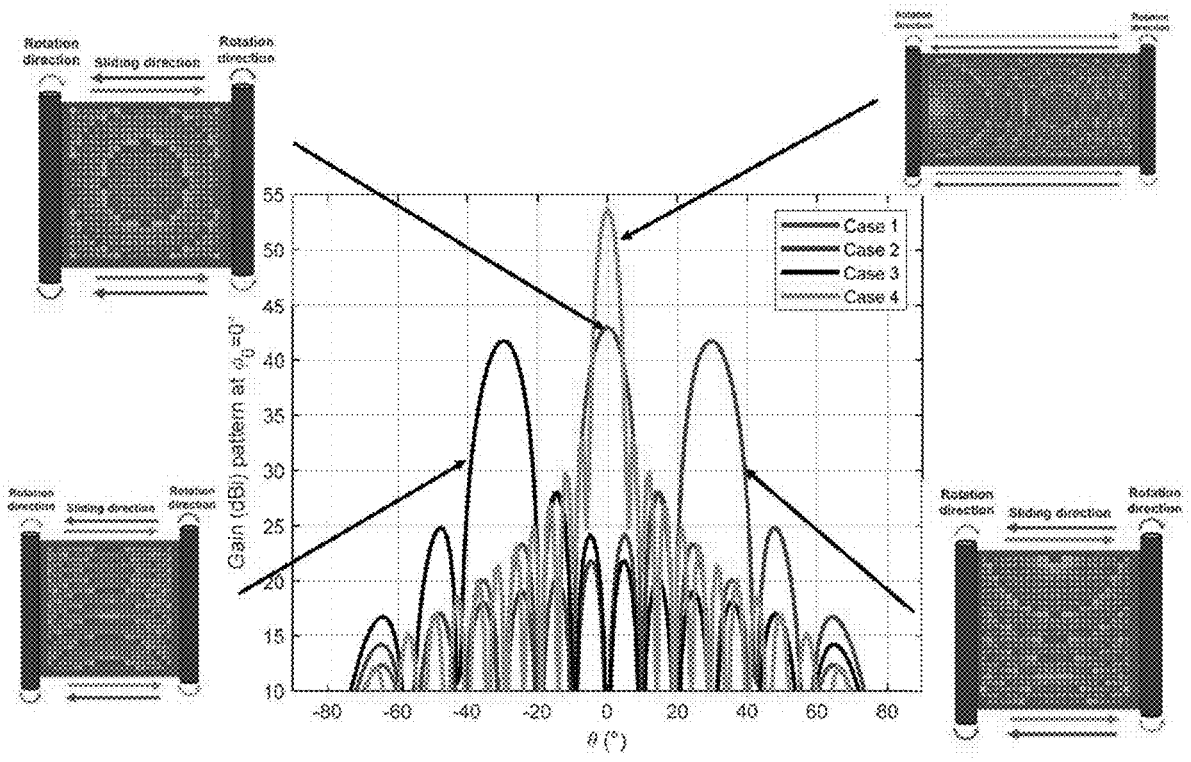
FIG. 14 is a diagram showing results of scanned radiation patterns of the rollable reflectarray antenna of the four cases of FIG. 13, according to an embodiment of the subject invention.

FIG. 14 is a diagram showing testing results of scanned radiation patterns of the scrollable and reconfigurable reflectarray reflecting surface of the four cases of FIG. 13(*a*)-(*d*). The results suggest that the scrollable and reconfigurable reflectarray of the subject invention is suitable for implementing high gain antennas with beam-steering capabilities that require low power.

The reflectarray can achieve broad beamsteering while maintaining the same aperture efficiency, utilizing a simple scrolling mechanism and optimally designed sub-reflectarrays, which form the reflectarray aperture for each position of scrolling that corresponds to a new beam direction.

The scrollable reflectarray can reconfigure the electromagnetic (EM) characteristics and can be efficiently packed. The ability of these structures to change their shape gives an additional degree of freedom for multi-functionality, such that the user can direct the beam in the desired direction not relying only on the electronic configuration that is conventionally used. The scrollable and reconfigurable reflectarrays achieves EM reconfigurability by a rotation of the reflecting surface and can be efficiently stowed in rolls to occupy a small volume, making it ideal for applications such as space communication systems, multi-functional communication system, deployable and collapsible arrays, and small satellites (SmallSats) or satellites of low mass and size, where beamsteering with low power and high efficiency is highly desirable.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A reconfigurable reflectarray antenna, comprising:

a flexible substrate;

a plurality of reflectarray patterns disposed on a surface of the flexible substrate, each reflectarray pattern comprising a plurality of reflectarray elements; and an actuator system coupled with the flexible substrate;

the actuator system being configured to scroll the flexible substrate to different operational positions such that when layout of the plurality of reflectarray patterns is changed, at least one electromagnetic (EM) characteristic of the reflectarray antenna is reconfigured, and phase distributions of the plurality of reflectarray elements being optimized to steer illuminating beams in predetermined directions.

2. The reconfigurable reflectarray antenna according to claim 1, configured such that in a predetermined operational position, an aperture of the reflectarray being formed by two reflectarray patterns that are optimized to direct an illuminating beam in a new direction.

3. The reconfigurable reflectarray antenna according to claim 1, the at least one EM characteristic comprising one or more of beamsteering, polarization, and frequency.

4. The reconfigurable reflectarray antenna according to claim 1, an optimization of phase distributions of the plurality of reflectarray elements being repeated for a plurality of times in each of two different directions.

5. The reconfigurable reflectarray antenna according to claim 1, the plurality of reflectarray elements being configured to operate in Ku-band at a center frequency of 16 GHz and with an element spacing of 18.75 mm (0.5λ).

6. The reconfigurable reflectarray antenna according to claim 5, a 313° range of reflection phase response being achieved with a maximum loss of 0.17 dB.

7. The reconfigurable reflectarray antenna according to claim 1, the plurality of reflectarray patterns having a fixed aperture size.

8. The reconfigurable reflectarray antenna according to claim 1, the plurality of reflectarray elements having a rectangular shape, a square shape, or a circular lattice shape.

9. The reconfigurable reflectarray antenna according to claim 1, the actuator system comprising two supporting members coupled to two ends of the flexible substrate, respectively.

10. The reconfigurable reflectarray antenna according to claim 9, the actuator system further comprising an actuator coupled to the two supporting members and configured to scroll the flexible substrate.

11. The reconfigurable reflectarray antenna according to claim 10, the actuator being configured to actuate the two supporting members to move the flexible substrate by a rotational motion or a sliding motion.

12. The reconfigurable reflectarray antenna according to claim 11, the actuator comprising a step motor.

13. The reconfigurable reflectarray antenna according to claim 1, the layout of the plurality of reflectarray patterns being moved into different operational positions to provide different directions of illuminating beams.

14. The reconfigurable reflectarray antenna according to claim 1, only one reflectarray pattern of the plurality of reflectarray patterns being exposed to be illuminated for each operational position.

15. The reconfigurable reflectarray antenna according to claim 1, the flexible substrate being made of plastic, polyimide, polyethylene terephthalate, or textile.

16. The reconfigurable reflectarray antenna according to claim 1, the surface of the flexible substrate on which the plurality of reflectarray patterns is disposed being a flat or a curved reflecting surface.

17. The reconfigurable reflectarray antenna according to claim 1, the flexible substrate having another surface opposite to the surface on which the plurality of reflectarray patterns is disposed and the another surface being at least partially covered by a metal.

18. The reconfigurable reflectarray antenna according to claim 17, the metal being copper or an alloy of copper.

19. A reconfigurable reflectarray antenna, comprising:

a flexible substrate;

a plurality of reflectarray patterns disposed on a surface of the flexible substrate, each reflectarray pattern comprising a plurality of reflectarray elements; and an actuator system coupled with the flexible substrate;

the actuator system being configured to scroll the flexible substrate to different operational positions such that when layout of the plurality of reflectarray patterns is changed, at least one electromagnetic (EM) characteristic of the reflectarray antenna is reconfigured, the reconfigurable reflectarray antenna being configured such that in a predetermined operational position, an aperture of the reflectarray being formed by two reflectarray patterns that are optimized to direct an illuminating beam in a new direction, the at least one EM characteristic comprising one or more of beamsteering, polarization, and frequency, phase distributions of the plurality of reflectarray elements being optimized to steer illuminating beams in predetermined directions, the plurality of reflectarray elements is configured to operate in Ku-band at a center frequency of 16 GHz and with an element spacing of 18.75 mm (0.5λ), a 313° range of reflection phase response being achieved with a maximum loss of 0.17 dB, the plurality of reflectarray patterns having a fixed aperture size, the plurality of reflectarray elements having a rectangular shape, a square shape, or a circular lattice shape, the actuator system comprising two supporting members coupled to two ends of the flexible substrate, respectively, the actuator system further comprising an actuator coupled to the two supporting members for scrolling the flexible substrate, the actuator being configured to actuate the two supporting members to move the flexible substrate by a rotational motion or a sliding motion, the actuator comprising a step motor, the layout of the plurality of reflectarray patterns being moved into different operational positions to provide different directions of illuminating beams, only one reflectarray pattern of the plurality of reflectarray patterns being exposed to be illuminated for each operational position, the flexible substrate being made of plastic, polyimide, polyethylene terephthalate, or textile, the surface of the flexible substrate on which the plurality of reflectarray patterns is disposed being a flat or a curved reflecting surface, the flexible substrate having another surface opposite to the surface on which the plurality of reflectarray patterns is disposed and the another surface being at least partially covered by a metal, and the metal being copper.

20. A method for optimizing phase distributions of a plurality of reflectarray elements of a reconfigurable reflectarray antenna to steer illuminating beams in predetermined directions, the method comprising:

step 1: optimizing phase distribution of an aperture of the reflectarray elements to have a broadside radiation ($\theta=0°$, $\phi=0°$);

step 2: shifting the reflectarray elements by $0.5\lambda \times C$ to a right direction and covering the reflectarray elements in the last C columns on the right side;

step 3: taking into account the new position of the reflectarray elements in radiation pattern from step 2 and calculating the phase distribution;

step 4: determining directions of the new beam ($\theta i$, $\phi i$);

step 5: radiating the new C columns on the left side of the reflectarray in the direction ($\theta i$, $\phi i$) determined in step 4 and calculating the required phase distribution; and step 6: combining the phases obtained from step 5 and step 2 to form a new reflectarray phase distribution.

* * * * *